US006004493A

United States Patent [19]

Hussong

[11] Patent Number: 6,004,493

[45] **Date of Patent: *Dec. 21, 1999**

[54] METHOD OF MAKING MINERAL FIBER PANELS

[75] Inventor: Dudley D. Hussong, Lakefield, Minn.

[73] Assignee: Hussong Manufacturing Co., Inc., Lakefield, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/922,691

[22] Filed: Sep. 2, 1997

[51] Int. Cl.[6] ..... B28B 1/26; B28B 1/48

[52] U.S. Cl. ..... 264/87; 264/154

[58] Field of Search ..... 264/86, 87, 154, 264/156

[56] References Cited

U.S. PATENT DOCUMENTS

| | | | |
|---|---|---|---|
| 3,070,485 | 12/1962 | Strickman | 264/86 |
| 3,250,839 | 5/1966 | De Luca | 264/86 |
| 3,377,229 | 4/1968 | Bryan | 161/22 |
| 3,510,394 | 5/1970 | Cadotte | 264/86 |
| 3,870,777 | 3/1975 | Jakel | 264/86 |
| 3,880,972 | 4/1975 | Towne et al. | 264/86 |
| 4,203,936 | 5/1980 | Kiwak et al. | 264/86 |
| 4,204,907 | 5/1980 | Korklan et al. | 264/87 |
| 4,775,705 | 10/1988 | Parker et al. | 264/86 |
| 4,786,451 | 11/1988 | Lampus | 264/86 |
| 4,882,114 | 11/1989 | Radvan et al. | 264/86 |
| 5,039,465 | 8/1991 | Freeman et al. | 264/86 |
| 5,087,397 | 2/1992 | Martinez | 264/87 |
| 5,271,888 | 12/1993 | Sinsley | 264/87 |
| 5,422,055 | 6/1995 | Yalvac et al. | 264/86 |
| 5,700,409 | 12/1997 | Corry | 264/86 |

FOREIGN PATENT DOCUMENTS

| | | | |
|---|---|---|---|
| 0329200 | 8/1989 | European Pat. Off. | 264/86 |
| 40 5 200713 | 8/1993 | Japan | 264/87 |
| 40 5 200714 | 8/1993 | Japan | 264/87 |
| 40 5 200715 | 8/1993 | Japan | 264/87 |
| 40 5 200716 | 8/1993 | Japan | 264/87 |

*Primary Examiner*—Karen Aftergut
*Attorney, Agent, or Firm*—Westman, Champlin & Kelly, P.A.

[57] ABSTRACT

A mineral fiber mat is formed from a slurry of a known fiber material and a binder in a vacuum mold. The mold includes a porous screen through which a vacuum is drawn to remove water from the slurry while leaving the mat on top of the screen. A cover is pressed down on the mat under the vacuum. The fiber mat or layer is formed to include a simulated surface, such as tree bark, or a brick wall. To form a hollow log the uncured layer is placed over a core to provide a partial enclosure around the core that is of a sufficient size to permit a gas burner to be placed in the enclosure and hidden from view. Panels that are to be used flat are cured while held flat.

8 Claims, 5 Drawing Sheets

METHOD OF MAKING MINERAL FIBER PANELS

BACKGROUND OF THE INVENTION

A hollow artificial log is formed by creating a mat or blanket of a mineral fiber and a binder is formed with a desired surface appearance. The mat or blanket may be used as formed or to make a log, further processed by forming the mat around a core so that it is at least a partial tube open at both ends, and it is then oven cured. A gas burner tube may be placed within the partial enclosure formed by the partial tubular log wall to simulate a real log burning.

In the prior art, various compositions and methods for making artificial logs for gas fireplace have been advanced, including vacuum forming of logs. However, the logs are generally solid and become quite heavy. An additional problem with the use of artificial logs has been that the gas burners used are difficult to hide and this results in the gas fireplace not having a true "natural" look.

In my copending application Ser. No. 08/569,483, filed Dec. 5, 1995, now U.S. Pat. No. 5,800,875, a method of forming solid logs is disclosed. The materials used are the same that are used with the present invention. Fiber logs such as that shown in my copending application are light weight. They also glow when flames impinge on the surface, and they look very realistic. The solid logs formed use a high volume of slurry containing water and thus require substantial drying time, and extra material. The production costs are increased because of the drying requirements.

Artificial logs were first made with refractory cement. The forming process was simple, and the logs looked reasonably natural, but they were very heavy, approximately ten times the weight of the present mineral fiber logs. Refractory cement logs would also become coated with carbon where the flame impinged on the log surface.

U.S. Pat. No. 3,377,229 shows a ceramic log that defines an open interior space. The ceramic log in patent '229 has a bottom support wall and a side wall which curves up and over the bottom support wall to simulate a log surface. The log is provided with end walls that define a cavity. The outer wall is formed in layers.

SUMMARY OF THE INVENTION

A slurry of mineral fibers, binder and water is placed in a mold and vacuum is used to dewater the slurry, to leave a layer of desired thickness in the mold. The mold has a surface on which one surface of the formed mat or layer is supported. The mold surface is provided with a negative pattern of a brick panel or a natural log, in a known manner. If the mat is to be used as a panel it is removed and dried.

The mat is usable for forming a hollow log for use in gas fireplaces. The log is part tubular and defines a hollow cavity. While the vacuum formed mat is still uncured, but is sufficiently dense to adhere together, it is removed and placed over a core or pattern to be formed into a part tubular member. The surface having the bark pattern is placed to the exterior of the core.

For forming a log the mat is formed of size so it extends over the core or pattern approximately between 100° and 180° when viewed in cross section. The mat and core are oven dried until the mat is completely cured, hard and rigid. The formed hollow log is removed from the core after oven drying, and when placed into a fireplace, the partial tube provides an internal cavity in which a gas burner tube can be located. The gas burner tube is substantially completely hidden from view from the front.

The formed log may be further processed before or after drying and provided with openings through the wall that will permit gas burner flames to pass through simulating natural burning of a log.

In the process, the mat or layer is vacuum formed in a mold to the desired thickness over a flat pattern in the mold that provides the bark or brick simulation on the exterior of the mat. In this process a substantial amount of water is removed from the slurry so that the mat layer of fibers and binder can be handled for further processing. Then the formed mat or layer may be supported in its desired shape for drying. For the preferred log configuration the mat, in its uncured state, is laid over a core or mold to take the shape of a partial tube having a cylindrical interior cross section. The core and the uncured mat are placed into an oven until the mat is completely cured, with the mineral fibers held together with a known binder, to form a rigid, hard surface hollow artificial log. The log is removed from the core after drying and can be trimmed up, and if desired subjected to other known treatments for completion. Then it is placed into a fireplace with a gas burner in the interior cavity of the formed artificial hollow log. The log fulfills the function of serving to make the gas burner fire look like a natural burning log fire, because the burner is hidden from view. Also, the benefits of the appearance of a mineral fiber log are provided.

The present process requires about only ⅕th of the material of a solid artificial log, and greatly reduces the dry time, which is a major factor in the overall production of artificial logs.

DETAILED DESCRIPTION OF THE PREFERRED EMBODIMENTS

Figure 1:
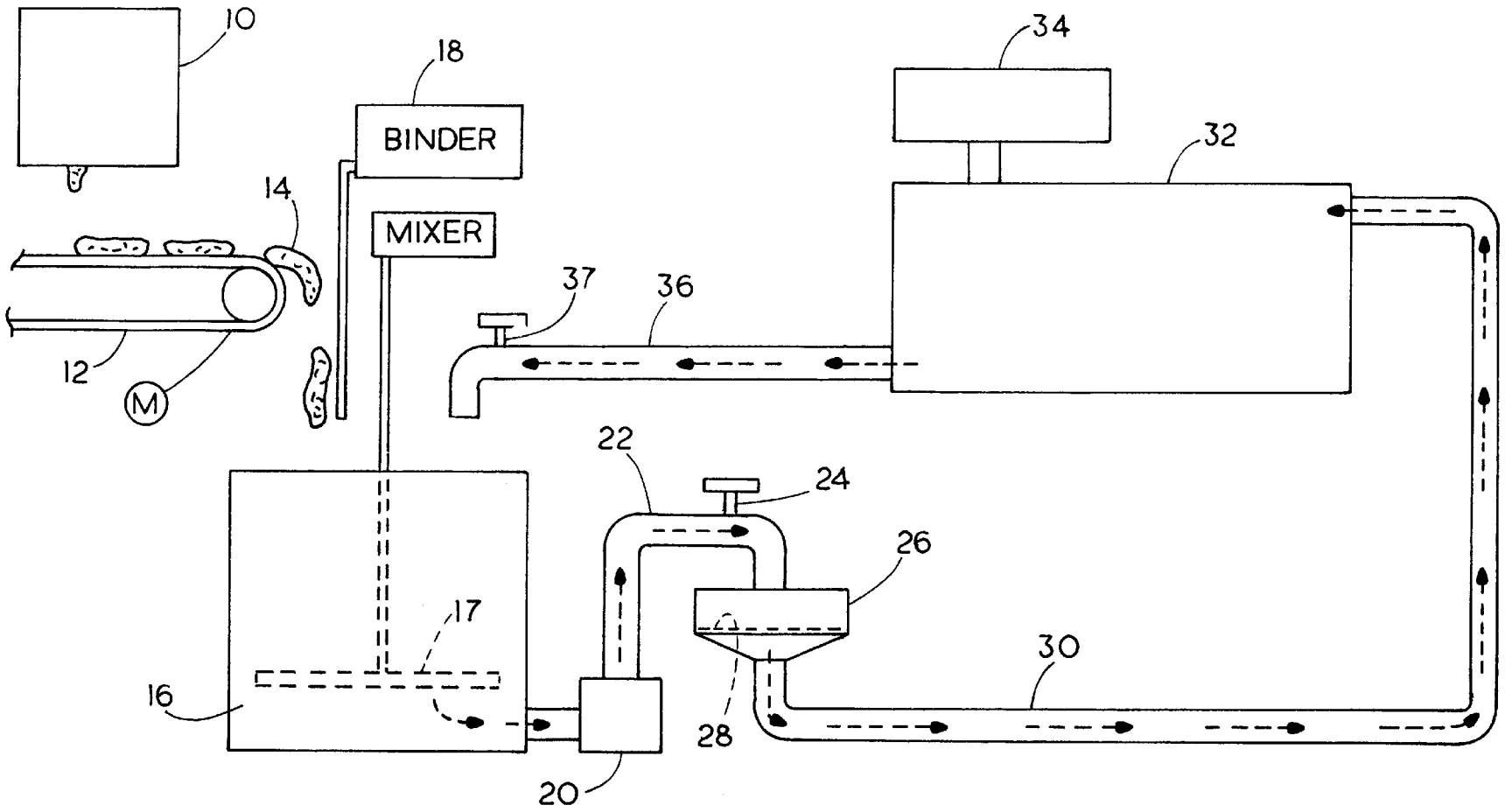
FIG. 1 is a schematic representation of a first step in the process of manufacturing an artificial log according to the present invention.

Referring to FIG. 1, a schematic representation of a first step of forming the artificial log of the present invention is illustrated. A supply of known mineral fibers from storage bin 10 provides fibers for forming logs in a conventional operation. Measured quantities of mineral fibers 14 are dropped onto a conveyor belt 12 of conventional design that carries the quantities of mineral fibers 14, such as mineral wool or the like, to an open top slurry tank 16. A suitable fiber binder from a source 18 is also dropped into the slurry tank 16. The slurry tank 16 has a mixer blade 17 to mix the mineral fibers 14 and binder with water to create a slurry. Water can be added from a source (not shown). Part of the water used for the slurry is greasy water previously removed from the slurry in a mold during an initial processing step of forming the artificial log of the present invention. The slurry components and consistency may be selected and are substantially the same as is used for forming solid artificial logs.

Figure 2:
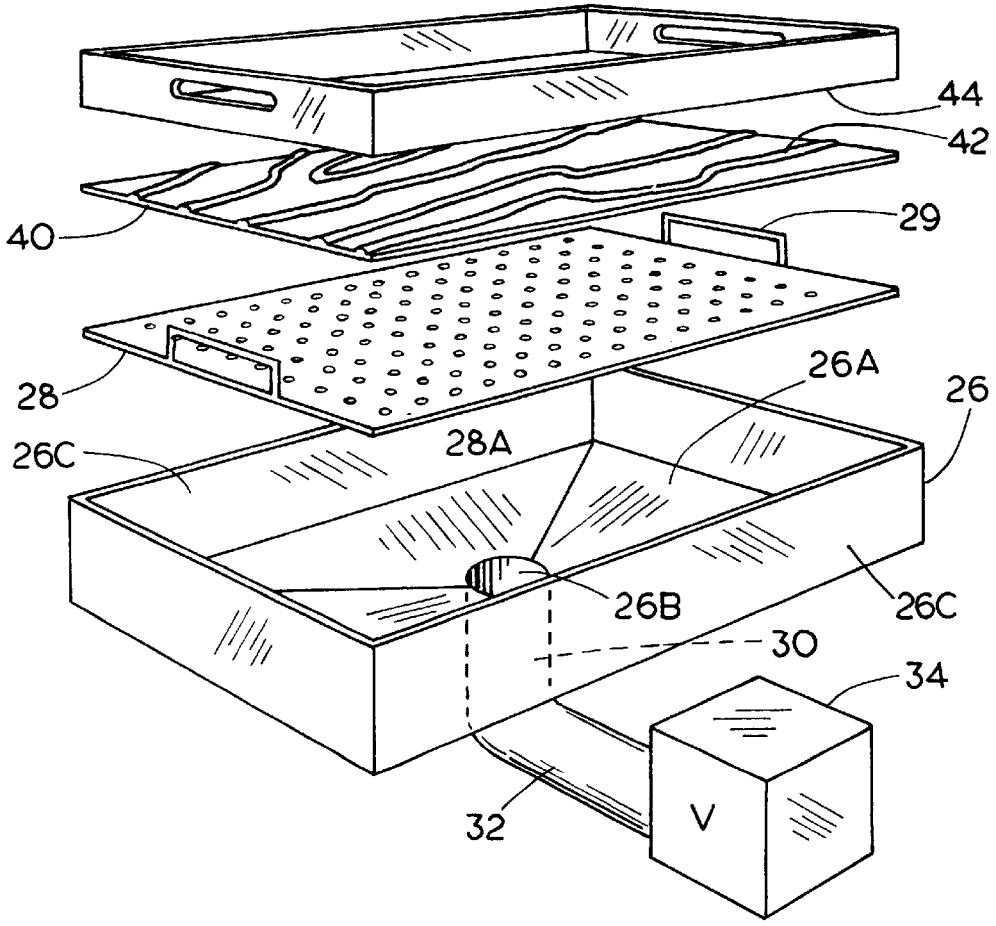
FIG. 2 is an exploded view of a vacuum mold used in the process shown in FIG. 1.
Figure 3:
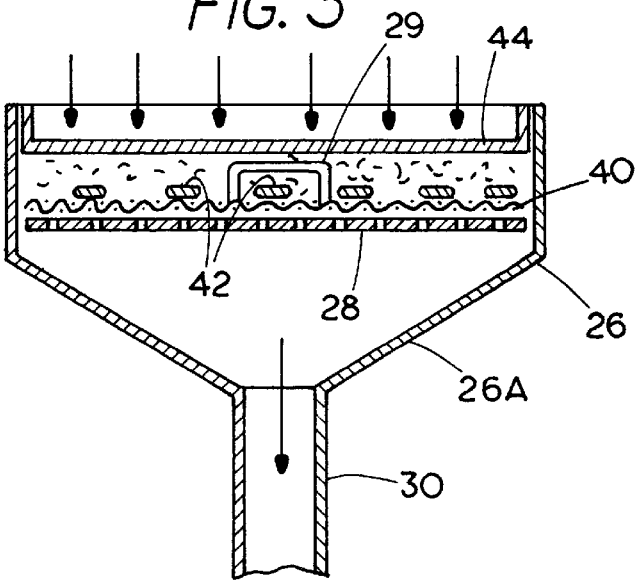
FIG. 3 is a sectional view of the mold pan shown in FIG. 2 in an assembled condition.

A pump 20 is used for drawing slurry from the tank 16, and providing the slurry through a conduit 22 and a control valve 24 into a vacuum mold pan 26. As shown in FIGS. 2 and 3. The pan 26 supports a perforated divider plate 28 that supports a screen or mesh pattern mold 40 forming a supporting surface. The slurry of mineral fibers binder and water is pumped into the pan 26 to a desired level. The screen mold 40 supports a layer of the mineral wool and binder slurry and prevents any substantial portion of the mineral fibers from passing through the perforated divider plate 28.

The pan 26 has a bottom wall 26A spaced from at least portion of perforated divider plate 28 that is tapered toward the central aperture 26B connected to a pipe 30. The pan 26 has solid side walls 26C that form a complete, open-topped enclosure. The perforated plate 28 is represented as having suitable perforations 28A therein, positioned to permit water to pass through and to provide a support for the screen 40 which has relatively small openings. The mineral fibers will be supported above the screen 40. The screen 40 has ribs 42 of screen or other material formed to simulate a bark pattern, for forming a log, or other surface patterns for panel, such as a brick pattern or an irregular bark configuration with raised portion with flame opening for a flat burner panel. The ribs 42 are porous so vacuum draws through them.

A cover 44 is provided for the vacuum pan 26, and in the process, once the slurry is filled into pan 26 to a suitable level, with the slurry supported above the screen 40, the cover 44 is put into place.

A conduit 30 opens to the bottom wall 26A of the pan 26 and connects to a vacuum tank 32. A vacuum pump 34 provides a vacuum in tank 32 and thus in pan 26 when a valve 37 in conduit 36 from tank 32 is closed and cover 44 is in place. The cover 44 can be provided with seals as desired. When vacuum is provided in the tank 32, there will be a flow as indicated by the arrows in the conduit 30 that will draw liquid through the screen 40 and perforated plate 28. This will be essentially "grey water" from the slurry in the tank 16. Mineral fibers and solid binder will be retained above the screen 40 and the perforated plate 28. In this way a mat of material fibers and binder can be formed on the surface of screen 40 (see FIGS. 2 and 2A) that is supported inside the pan 26.

Figure 2A:
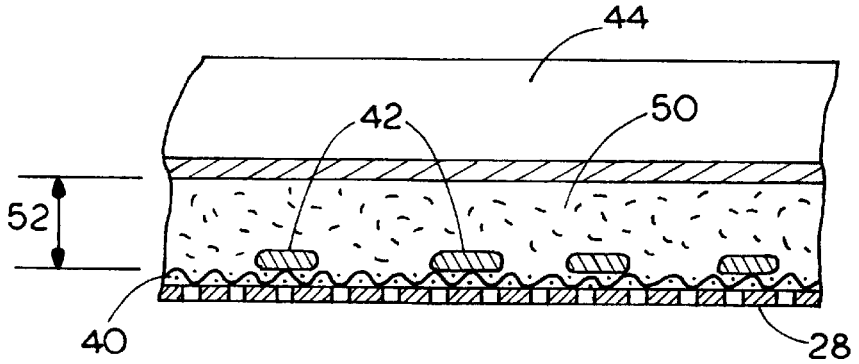
FIG. 2A is an enlarged detailed view of a mold pan shown with a formed mat in the mold.

It can be seen in FIG. 2 and also in FIG. 2A that the screen mold 40 is provided with metal gauze ridges 42 on its upper surface. The ridges are formed in a random pattern to simulate a bark pattern from a tree, or other patterns, such as brick or a series of top sides of logs. These ridges are formed in a known manner, with metal gauze that will permit air to pass through, so that during the vacuum forming the slurry water will pass through these portions of the mold but a mat or layer 50 will be left in the molding pan 26.

The cover 44 is also drawn down toward the screen 40 to tend to squeeze the panel down tightly against the screen. This action tightens the fibers and causes a mat that is bound together, and the ribs or patterns are defined sharply. The one side of the mat will be smooth and the pattern will be on the other.

The volume of material deposited in pan 26 from the slurry tank 16 by the pump 20 can be adjusted so that the level in mold 26 will provide a sufficient thickness represented at 52, for the mat or layer above the screen 40 to give the desired effect for the finished hollow artificial log or other product, such as a panel. Also the mat 50 has to be bonded well enough to withstand some handling.

The force of the vacuum drawing the cover 44 down toward the screen pattern 40, squeezes the mat or layer 50 during forming. In FIG. 2A the cover 44 is represented, and shown squeezing the mat 50 down against the screen 40 to form grooves in the mat where the mold ribs or ridges 42 forming the desired pattern are placed.

After approximately 80% of the water from the slurry of the binder and the mineral fibers has been removed, the mat 50 will have a thickness 52 in the range of ½ inch, and the fibers will be sufficiently bonded together so that the mat can be handled gently.

The perforated plate 28 has handles 29 along the ends so that once the vacuum forming is completed, and the vacuum pump is turned off, the cover 44 can be removed and the perforated plate 28, screen 40 and the formed, but still wet, mat 50 removed from the vacuum pan 26.

Figure 5:
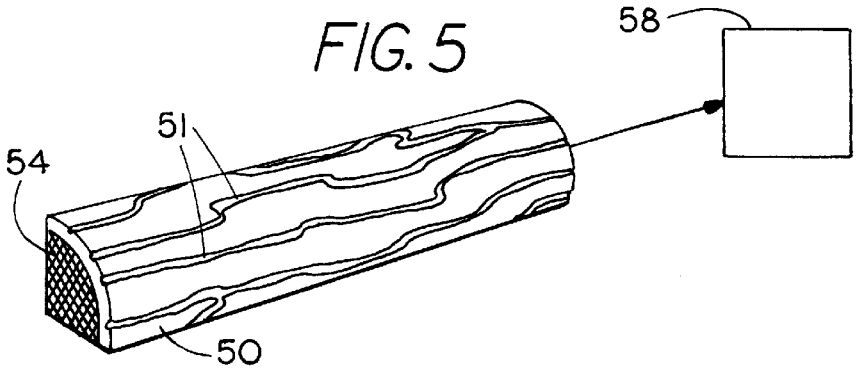
FIG. 5 is a perspective view of the mat of FIG. 4 over a core for drying in an oven.

The perforated plate, screen and mat are then removed from the pan 26 and if a log is to be formed, the mat is placed over a core or form 54, shown in FIG. 5. The core 54 is made of screen as well and is formed to the desired cross sectional configuration of the artificial log.

Figure 4:
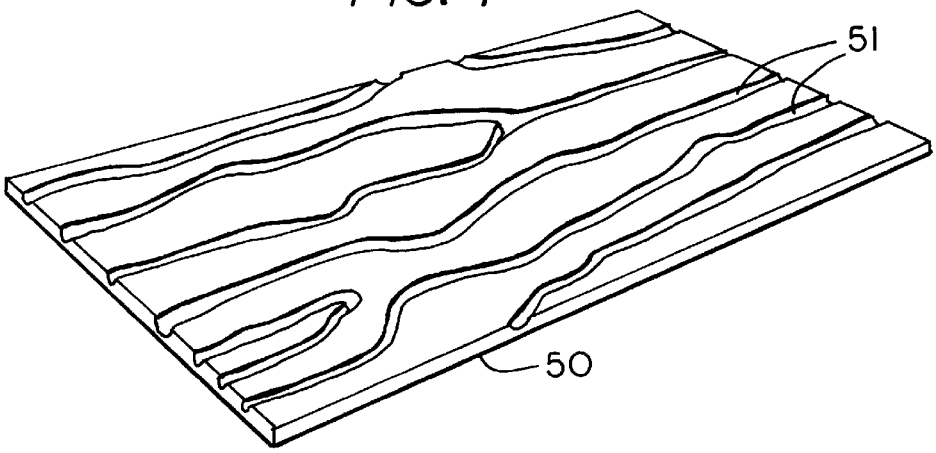
FIG. 4 is a perspective view of a partially formed log mat or layer used for forming the artificial hollow log of the present invention.

As shown in FIG. 4, the mat 50 is much like a wet blanket, with a tree bark pattern indicated at 51 on one side. The pattern 51 is formed by the ribs 42 on the screen. The mat 50 can be handled carefully and laid over the core 54, for example by inverting the screen 40 and perforated plate over the core 54. The mat 50 forms a layer around the core 54 in a partial tubular shape. The core 54 is selected to be of suitable size, so that the mat forms a hollow log section.

The core 54 and the uncured mat 50 are then moved to an oven 58, and the mat 50 is dried using the desired temperatures and time sufficient so that the binder is activated and the mineral fibers are held together solidly.

Figure 6:
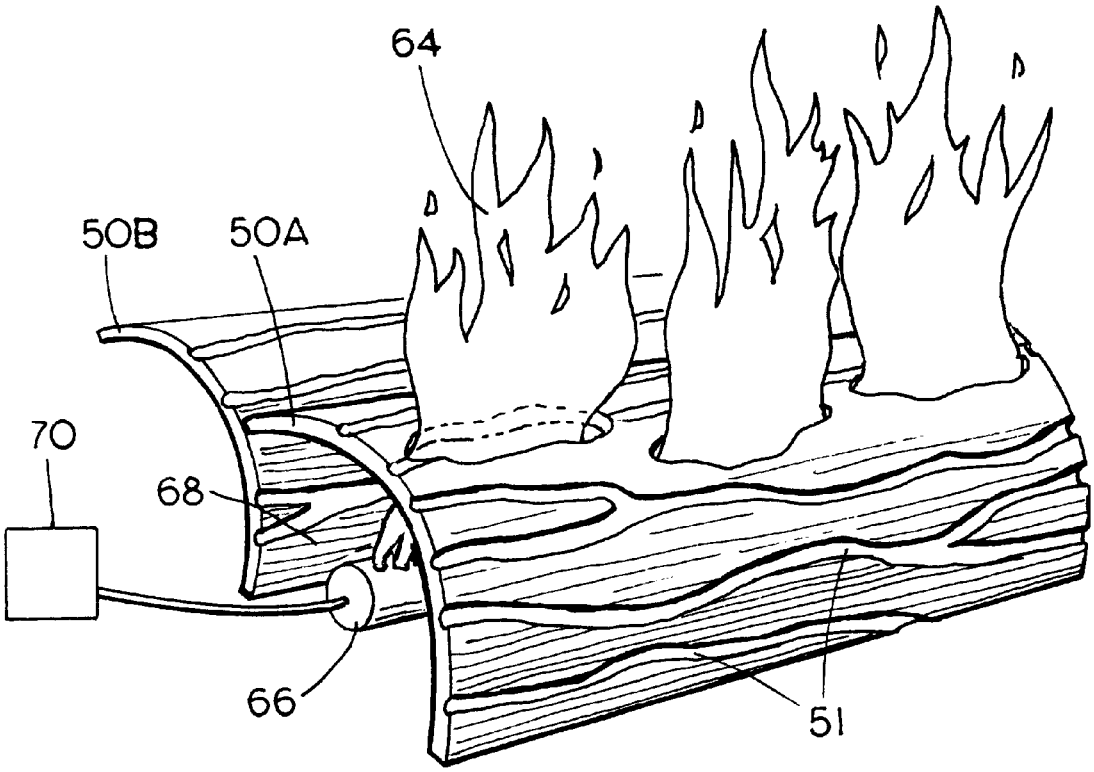
FIG. 6 is a fragmentary perspective view of an artificial log made according to the present invention in a fireplace with a gas burner pipe therein, showing flames coming through provided openings in the hollow artificial log.

After curing in the oven for a selected time, the mat 50 becomes a rigid hollow log 50A as shown in FIG. 6. The log 50A is self-supporting along one edge. The artificial log 50A can be supported in a suitable manner on its back edge, such as resting against a second log shown at 50B in FIG. 6 or rested on a support. The artificial logs can be varied in size by varying the screen size. The amount of arc of the log wall can be in the range of between 90° and 180° if desired.

As shown, the formed artificial log 50A has a substantially planar front wall 50C, and after being formed, openings 62 may be created in the log wall. A burner tube 66 will fit within the interior cavity 68 of the hollow log. The burner tube 66 is connected to suitable controls and a gas source 70 for providing fuel for burning in a fireplace. Because the burner tube 66 is within the cavity 68, it is completely hidden from view from the front of the fireplace. The openings 62 in the artificial log permit the flames to pass up through the openings, giving an appearance of actually consuming the log. The material in the artificial log 50A will glow in a natural manner, and provide a very pleasant appearance.

The drying time for a blanket or mat 50 is substantially reduced over a solid log, and thus provides an advantage in cost savings over conventional solid logs.

The mat provides a uniform thickness wall behind which the gas burner tube 66 is placed. The artificial log does not have a bottom support wall, in its preferred embodiment, which would interfere with placing the gas log directly below the upwardly and laterally curving wall of the artificial log.

Figure 7:
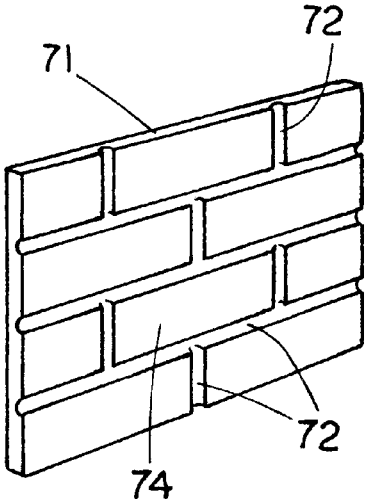
FIG. 7 is a perspective view of a simulated brick panel formed by the process and dried flat.

The process of forming the mat, as set forth in FIGS. 1, 2 and 3 can be advantageously used for forming other mineral fiber panels for use in high temperature applications, such as liners for gas fireplace inserts, or burner covers. FIG. 7 shows a panel 71 formed from a mat such as that shown at 50 with appropriate ribs in place for forming the lines indicated at 72 between a brick shape 74. This panel 71 is formed as a mat shown in FIG. 4 and then is dried or cured, either by air drying it on a flat surface, or putting into the oven for baking and curing immediately. It can be trimmed to size after the mat is formed to make the correct size panels. Once formed and cured the panel may be used inside a gas fireplace for lining the fireplace walls to simulate a brick wall. The process provides a low cost and very efficient way of forming mineral fiber panels that are heat resistant and can be made to simulate surfaces as desired.

Figure 8:
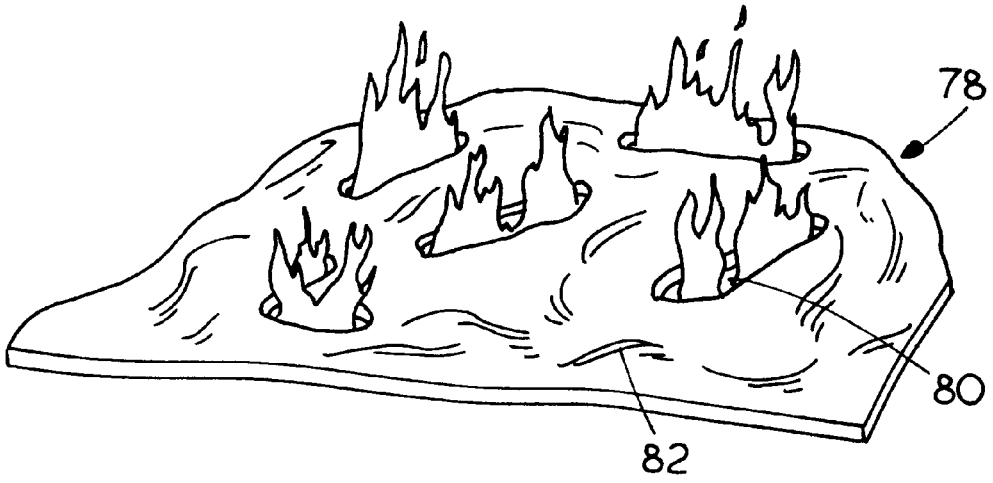
FIG. 8 is a perspective view of a flat burner cover also formed by the process and dried flat or partially curved.

In FIG. 8, a panel that forms a burner cover is shown at 78. This too is formed as a mat 50 with the ribs 42 replaced with suitable ribbing mold members to form raised areas 80, and to provide a surface configuration 82. The areas 80 can be made by replacing screen 40 with a similar screen having depressions that form raised regions on the mat after forming. Also the mat would be supported on a flat surface for drying, trimming, and for curing in the oven.

The process thus includes not only the formation of a simulated log which is a preferred way of forming simulated, lightweight hollow logs, but also for making panels that may remain flat but can be molded and formed quickly using the slurry and the vacuum forming mold shown in FIG. 2. The screen support 40 can be undulated, or contoured, for forming the type of burner cover, or raised rib sections can be used. The screen support includes the negative pattern desired and then the top cover 44 is pressed down on the mat when vacuum is applied for providing a mat that can be handled and is made to a particular size of the container 26.

The apertures that are needed for the gas flame orifices in a burner cover can be formed after the panel is formed and even after it has dried, if desired.

The hollow artificial log of the present invention thus is formed from a layer having a substantially uniform thickness extending from an edge that is supportable on the bottom wall of a fireplace, and extending upwardly and laterally in a desired curve to terminate at an upper level, before curving downwardly.

Although the present invention has been described with reference to preferred embodiments, workers skilled in the art will recognize that changes may be made in form and detail without departing from the spirit and scope of the invention.

What is claimed is:

1. A process of forming a mineral fiber panel comprising the steps of:

providing a slurry of mineral fibers and a binder in a liquid;

forming a mat from the mineral fibers and binder slurry by removing liquid from the slurry to bind the fibers together while the mat is supported on a porous mold support providing a desired surface configuration for the mat;

wherein a vacuum is drawn through the porous mold support to remove the liquid while squeezing the mat with a member urged toward the support during the forming step solely by drawing the vacuum through the porous mold support; and drying the formed mat to rigidify the mineral fibers and binder.

2. The method of claim 1 including the step of placing the mat over a preformed core to form the mat into a convex exterior configuration having a first laterally extending wall portion overlying the core to form a self-supporting artificial log.

3. The method of claim 1, including the step of forming the surface configuration to simulate a log on the mold support.

4. The method of claim 3, including the step of forming apertures in the mat.

5. The method of claim 2 including the step of providing a screen material core as the preformed core and placing the core and mat supported thereon into an oven to perform the drying step.

6. The method of claim 5, wherein the mat is supported on a screen inside a housing, the screen permitting water to pass therethrough but selected to support the mineral fibers thereon, and including the further step of providing the screen with the configuration, and providing the member with a planar surface to form a panel having one flat side.

7. The method of claim 5 including the step of providing the surface configuration simulating a log.

8. The method of claim 1 including the step of providing the surface configuration simulating a brick construction surface.

* * * * *